US009864394B2

(12) United States Patent
Katsushima

(10) Patent No.: US 9,864,394 B2
(45) Date of Patent: Jan. 9, 2018

(54) REFERENCE VOLTAGE GENERATION CIRCUIT WITH STARTUP CIRCUIT

(71) Applicant: Torex Semiconductor Ltd., Tokyo (JP)

(72) Inventor: Yousuke Katsushima, Tokyo (JP)

(73) Assignee: Torex Semiconductor Ltd., Tokyo (JP)

( * ) Notice: Subject to any disclaimer, the term of this patent is extended or adjusted under 35 U.S.C. 154(b) by 0 days.

(21) Appl. No.: 15/403,428

(22) Filed: Jan. 11, 2017

(65) Prior Publication Data

US 2017/0199541 A1 Jul. 13, 2017

(30) Foreign Application Priority Data

Jan. 12, 2016 (JP) ..... 2016-003174

(51) Int. Cl.
*G05F 3/24* (2006.01)
*G05F 3/26* (2006.01)

(52) U.S. Cl.
CPC ..... *G05F 3/262* (2013.01)

(58) Field of Classification Search
CPC ..... G05F 3/24; G05F 3/262
USPC ..... 323/313, 314, 315, 901
See application file for complete search history.

(56) References Cited

U.S. PATENT DOCUMENTS 6,259,240 B1 * 7/2001 Smith ..... G05F 1/468 323/313
6,677,810 B2 * 1/2004 Fukui ..... G05F 3/262 323/315
7,554,313 B1 * 6/2009 Leitner ..... G05F 3/262 323/315
8,022,686 B2 * 9/2011 Lu ..... G05F 3/30 323/315
2007/0057717 A1 * 3/2007 Choi ..... G05F 3/262 327/543
2014/0077791 A1 * 3/2014 Zhang ..... G05F 3/30 323/314
2015/0205319 A1 * 7/2015 De Cremoux ..... H02M 3/18 331/109
2016/0124454 A1 * 5/2016 Chellappa ..... G05F 3/262 323/315
2017/0199541 A1 * 7/2017 Katsushima ..... G05F 3/262

FOREIGN PATENT DOCUMENTS

JP 2005228291 A 8/2005
JP 201345213 A 3/2013

* cited by examiner

*Primary Examiner* — Jeffrey Sterrett
(74) *Attorney, Agent, or Firm* — The Webb Law Firm

(57) ABSTRACT

In a reference voltage generation circuit, a reference voltage generation unit 1 is configured to receive, as feedback, a voltage of an output terminal 3; a startup circuit unit 2 has a depletion MOS transistor TR1, and enhancement MOS transistors TR2, TR3; the MOS transistor TR1 has one end connected to a power source 4 and is formed as a constant current connection; the MOS transistor TR2 has one end connected to the power source 4 via a resistor RST, has an opposite end connected to the output terminal 3, and further has a gate connected to an opposite end of the MOS transistor TR1; and the MOS transistor TR3 has one end connected to the opposite end of the MOS transistor TR1, has an opposite end grounded, and further has a gate connected to the output terminal 3. The reference voltage generation circuit can reduce the occurrence of a wasteful current consumption after circuit startup.

6 Claims, 2 Drawing Sheets

REFERENCE VOLTAGE GENERATION CIRCUIT WITH STARTUP CIRCUIT

CROSS-REFERENCE TO RELATED APPLICATION

This application claims priority to Japanese Patent Application No. 2016-003174 filed Jan. 12, 2016, the disclosure of which is hereby incorporated in its entirety by reference.

TECHNICAL FIELD

This invention relates to a reference voltage generation circuit useful when applied in generating a predetermined reference voltage stably.

BACKGROUND ART

A reference voltage generation circuit is in wide use as a power source for driving a semiconductor device stably. The reference voltage generation circuit is a constant voltage source for generating a reference voltage $V_{ref}$ within the semiconductor device which does not depend on a power supply voltage VDD outside the semiconductor device. This type of reference voltage generation circuit may undergo a startup failure of the circuit, that is, may have zero output voltage at startup of the circuit, because depending on the circuit configuration, the output of a reference voltage generation unit which directly generates the reference voltage $V_{ref}$ has two values as solutions, i.e., 0V (with respect to GND) and the reference voltage $V_{ref}$ being a specified voltage. Such a startup failure could occur in a circuit of a mode in which the reference voltage $V_{ref}$ serving as the output voltage is provided as feedback to the reference voltage generation unit. With such a type of reference voltage generation circuit, therefore, a startup circuit unit is integrally connected to the reference voltage generation unit generating the reference voltage $V_{ref}$ and, at the startup of the circuit, a predetermined current is flowed into the reference voltage generation unit by the startup circuit unit to start the circuit.

As publicly known documents which disclose a reference voltage generation circuit formed by integration of a reference voltage generation unit and a startup circuit unit, Patent Documents 1 and 2, for example, are present.

PRIOR ART DOCUMENTS

Patent Documents

[Patent Document 1] JP-A-2013-045213 (FIG. 1)
[Patent Document 2] JP-A-2005-228291 (FIG. 16)

SUMMARY OF THE INVENTION

Problems to be Solved by the Invention

The circuit in FIG. 1 of Patent Document 1 above is configured such that simultaneously with power-on, a current directly flows into a reference voltage circuit via a resistor. As a result, even if the reference voltage circuit transfers into a steady drive state after startup of the circuit, the same current as that at startup flows via the resistor, and a loss due to this current is induced. Since the same current as that at startup continues to flow via the resistor, moreover, changes in the reference voltage which is the output voltage may be induced if V0 fluctuates owing to an external factor or the like.

In the circuit in FIG. 16 of Patent Document 2, a great current flows into an output terminal via a transistor Q16 even when a steady state is achieved after startup of BGR. Thus, a relatively great electric power consumption as a wasteful consumption occurs. If VCC fluctuates in the steady state owing to an external factor, a current may flow in via R4, causing changes in $V_{out}$ which is the output voltage.

The present invention has been accomplished in the light of the above-mentioned earlier technologies. It is an object of the invention to provide a reference voltage generation circuit which, when a startup circuit unit is combined with a reference voltage generation unit in order to avoid a startup failure of the reference voltage generation unit, can perform the startup of the reference voltage generation circuit reliably with a simple circuit configuration, and can also minimize the occurrence of a wasteful power consumption after circuit startup.

Means for Solving the Problems

A first aspect of the present invention for attaining the above object is a reference voltage generation circuit including a reference voltage generation unit for generating a reference voltage, and a startup circuit unit, wherein the reference voltage generation unit is configured to receive, as feedback, a voltage of an output terminal for outputting the reference voltage;

the startup circuit unit has a first transistor which is a depletion MOS transistor, a second transistor which is an enhancement MOS transistor, and a third transistor which is an enhancement MOS transistor;

the first transistor has one end connected to a power source and is formed as a constant current connection;

the second transistor has one end connected to the power source via a resistor, has an opposite end connected to the output terminal, and further has a gate connected to an opposite end of the first transistor; and the third transistor has one end connected to the opposite end of the first transistor, has an opposite end grounded, and further has a gate connected to the output terminal.

A second aspect of the present invention is the reference voltage generation circuit according to the first aspect, wherein the on-resistance of the third transistor is lower than the on-resistance of the first transistor.

A third aspect of the present invention is the reference voltage generation circuit according to the first or second aspect, wherein the third transistor is mirror connected to a transistor which, in the reference voltage generation unit, generates the reference voltage in the output terminal.

A fourth aspect of the present invention is the reference voltage generation circuit according to the first or second aspect, wherein the reference voltage generation unit has a constant current generation unit and a constant voltage generation unit, the constant current generation unit is constituted by connecting a fourth transistor, a fifth transistor, and a resistor in series, and generates a predetermined constant current, and the constant voltage generation unit comprises a sixth transistor, which is mirror connected to the fourth transistor, and a seventh transistor connected in series with the sixth transistor, and generates the reference voltage by a gate-source voltage of the seventh transistor, the seventh transistor being mirror connected to the third transistor.

Effects of the Invention

According to the present invention, even if a startup failure is caused in the reference voltage generation unit and the reference voltage $V_{ref}$ as the output voltage of the reference voltage generation unit is 0V, the third transistor is in an OFF-state. Thus, upon startup of the circuit, the first transistor is reliably started to turn the second transistor on, whereby a predetermined current flows into the output terminal via the resistor. As a result, the reference voltage generation unit of the reference voltage generation circuit is started reliably.

MODE FOR CARRYING OUT THE INVENTION

Figure 1:
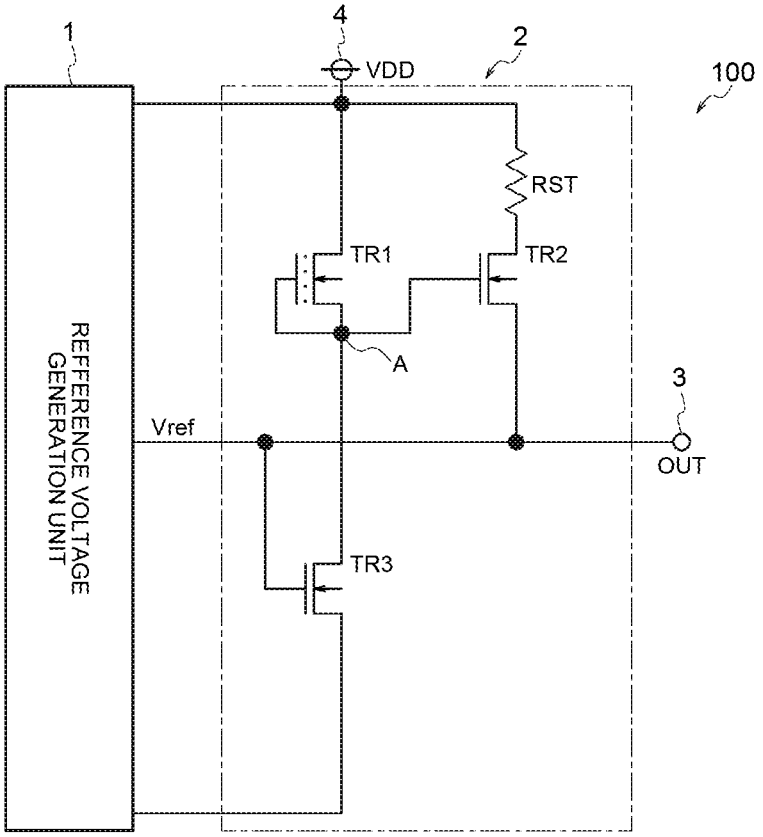
FIG. 1 is a block diagram showing a reference voltage generation circuit according to the present invention.

The embodiment of the present invention will now be described in detail with reference to the accompanying drawings. FIG. 1 is a block diagram showing a reference voltage generation circuit according to the embodiment of the present invention. As shown in this drawing, a reference voltage generation circuit 100 is composed of a reference voltage generation unit 1, and a startup circuit unit 2 for starting the reference voltage generation unit 1.

The reference voltage generation unit 1 generates a predetermined reference voltage $V_{ref}$ in an output terminal 3. This reference voltage $V_{ref}$ serves as an output voltage OUT. The reference voltage generation unit 1 is configured to receive, as feedback, the output voltage OUT of the output terminal 3.

The startup circuit unit 2 is connected to the output side of the reference voltage generation unit 1 so as to supply a predetermined current to the reference voltage generation unit 1 at the startup of the reference voltage generation unit 1 for the purpose of avoiding a startup failure caused because the output of the reference voltage generation unit 1 has two values, i.e., 0V (with respect to GND) and the reference voltage $V_{ref}$ being a specified voltage, as solutions. The startup circuit unit 2 has a depletion MOS transistor TR1 (first transistor), an enhancement MOS transistor TR2 (second transistor), and an enhancement MOS transistor TR3 (third transistor). The MOS transistor TR1 has one end connected to a power source 4 supplying a power supply voltage VDD, and is formed as a constant current connection. The MOS transistor TR2 has one end connected to the power source 4 via a resistor RST, and has the other end connected to the output terminal 3. That is, the MOS transistor TR2 is connected to the power source 4 in parallel with the MOS transistor TR1. Also, the MOS transistor TR2 has a gate connected to the other end of the MOS transistor TR1. The MOS transistor TR3 has one end connected to the other end of the MOS transistor TR1, and has the other end grounded (GND). That is, the MOS transistor TR3 is connected to the power source 4 in series with the MOS transistor TR1. The gate of the MOS transistor TR3 is connected to the output terminal 3. The on-resistance of the MOS transistor TR3 is selected to be lower than the on-resistance of the MOS transistor TR1.

In the startup circuit unit 2 of the above configuration, even if the reference voltage $V_{ref}$ being the output voltage OUT is 0V as a result of a startup failure in the reference voltage generation unit 1, a node A connected to the source of the depletion MOS transistor TR1 and the gate of the MOS transistor TR2 has the power supply voltage VDD, because the MOS transistor TR3 is in an OFF-state. Thus, the MOS transistor TR2 enters an ON-state. As a consequence, a current flows from the power source 4 into the output terminal 3 via the resistor RST, and the reference voltage generation unit 1 is started, whereupon the reference voltage $V_{ref}$ is outputted from the output terminal 3.

Upon startup of the reference voltage generation unit 1, the MOS transistor TR3 is brought into an ON-state. As a result, the current from the power source 4 flows from the MOS transistor TR1 to the ground (GND) via the MOS transistor TR3. Consequently, the potential of the node A lowers and, accordingly, the potential of the gate of the MOS transistor TR2 falls to a value below its threshold value, with the result that the MOS transistor TR2 comes to the OFF-state. Thus, the inflow of the current into the output terminal 3 via the resistor RST and the MOS transistor TR2 is blocked. In the present embodiment, (on-resistance of MOS transistor TR1)>(on-resistance of MOS transistor TR3). Thus, the MOS transistor TR2 can be changed into the OFF-state more reliably and more promptly, whereby the above-mentioned state can be maintained. As a result, the inflow of the current via the MOS transistor TR2, which is a factor for fluctuating the reference voltage $V_{ref}$, can be blocked reliably during normal operation of the reference voltage generation circuit 100. During steady operation after circuit startup, therefore, the situation where the current via the startup circuit unit flows into the output terminal 3, as in Patent Document 2, does not occur, and disturbance factors for the reference voltage $V_{ref}$ to be produced in the output terminal 3 can be eliminated reliably.

Figure 2:
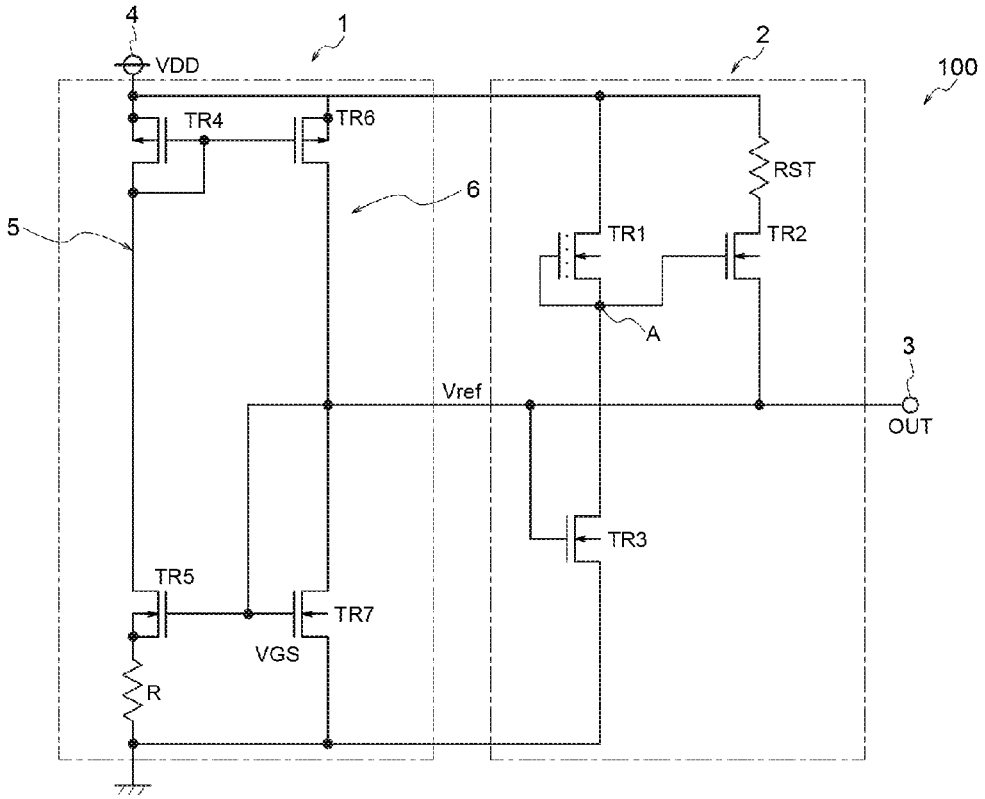
FIG. 2 is a circuit diagram showing a concrete circuit configuration example of a reference voltage generation unit of the reference voltage generation circuit shown in FIG. 1, in combination with a startup circuit unit.

As described above, the reference voltage generation unit 1 is configured to receive, as feedback, the output voltage OUT of the output terminal 3. That is, the reference voltage generation unit 1 has such a circuit configuration that its output has two values, i.e., 0V and the reference voltage $V_{ref}$ being a specified voltage, as solutions. The reference voltage generation unit 1 can be combined with the startup circuit unit 2, without any other limitation imposed thereon, aside from these features. FIG. 2 is a circuit diagram showing the reference voltage generation circuit 100 comprising a combination of an example of the reference voltage generation unit 1, which illustrates a circuit configuration concretely, and the startup circuit unit 2. As shown in the drawing, the reference voltage generation unit 1 of the present embodiment has a constant current generation unit 5 and a constant voltage generation unit 6. The constant current generation unit 5 is constituted by connecting a MOS transistor TR4 (fourth transistor), a MOS transistor TR5 (fifth transistor), and a resistor R in series, and generates a predetermined constant current. The constant voltage generation unit 6 comprises a MOS transistor TR6 (sixth transistor), which is mirror connected to the MOS transistor TR4, and a MOS transistor TR7 (seventh transistor) connected in series with the MOS transistor TR6, and generates the reference voltage $V_{ref}$ which is the predetermined constant voltage. In more detail, in the constant current generation unit 5, the constant current is generated by the MOS transistor TR4 in diode connection. As a result, the predetermined constant current is supplied to the MOS transistor TR7 via the transistor TR6 forming a mirror circuit together with the MOS transistor TR4 to generate a predetermined constant voltage VGS between the gate and the source of the transistor TR7. Using this constant voltage VGS, the reference voltage $V_{ref}$ is generated.

In the present embodiment, the MOS transistor TR3 of the startup circuit unit 2 is mirror connected to the MOS transistor TR7. By adjusting the size ratio between the MOS transistors TR3 and TR7, therefore, the current flowing into the MOS transistor TR3 during steady operation can be minimized. The size ratio is a constant dependent on the channel lengths or channel widths of the MOS transistors TR3, TR7. By making the size of the MOS transistor TR3 sufficiently small as compared with the size of the MOS transistor TR7, the current flowing into the MOS transistor TR3 during steady operation can be rendered small, and a wasteful current consumption can be curtailed.

INDUSTRIAL APPLICABILITY

The present invention can be utilized effectively in industrial fields where semiconductor devices, etc. requiring a stable constant voltage as a reference are manufactured.

EXPLANATIONS OF LETTERS OR NUMERALS

1 Reference voltage generation unit
2 Startup circuit unit
3 Output terminal
4 Power source
TR1 to TR3 MOS transistor
RST Resistor
$V_{ref}$ Reference voltage
VDD Power supply voltage
100 Reference voltage generation circuit

The invention claimed is:

1. A reference voltage generation circuit including a reference voltage generation unit for generating a reference voltage, and a startup circuit unit, wherein the reference voltage generation unit is configured to receive, as feedback, a voltage of an output terminal for outputting the reference voltage;

the startup circuit unit has a first transistor which is a depletion MOS transistor, a second transistor which is an enhancement MOS transistor, and a third transistor which is an enhancement MOS transistor;

the first transistor has one end connected to a power source and is formed as a constant current connection;

the second transistor has one end connected to the power source via a resistor, has an opposite end connected to the output terminal, and further has a gate connected to an opposite end of the first transistor; and the third transistor has one end connected to the opposite end of the first transistor, has an opposite end grounded, and further has a gate connected to the output terminal.

2. The reference voltage generation circuit according to claim 1, wherein an on-resistance of the third transistor is lower than an on-resistance of the first transistor.

3. The reference voltage generation circuit according to claim 2, wherein the reference voltage generation unit has a constant current generation unit and a constant voltage generation unit, the constant current generation unit is constituted by connecting a fourth transistor, a fifth transistor, and a resistor in series, and generates a predetermined constant current, and the constant voltage generation unit comprises a sixth transistor, which is mirror connected to the fourth transistor, and a seventh transistor connected in series with the sixth transistor, and generates the reference voltage by a gate-source voltage of the seventh transistor, the seventh transistor being mirror connected to the third transistor.

4. The reference voltage generation circuit according to claim 2, wherein the third transistor is mirror connected to a transistor which, in the reference voltage generation unit, generates the reference voltage in the output terminal.

5. The reference voltage generation circuit according to claim 1, wherein the reference voltage generation unit has a constant current generation unit and a constant voltage generation unit, the constant current generation unit is constituted by connecting a fourth transistor, a fifth transistor, and a resistor in series, and generates a predetermined constant current, and the constant voltage generation unit comprises a sixth transistor, which is mirror connected to the fourth transistor, and a seventh transistor connected in series with the sixth transistor, and generates the reference voltage by a gate-source voltage of the seventh transistor, the seventh transistor being mirror connected to the third transistor.

6. The reference voltage generation circuit according to claim 1, wherein the third transistor is mirror connected to a transistor which, in the reference voltage generation unit, generates the reference voltage in the output terminal.

* * * * *